US005553527A

United States Patent [19]

Harrison

[11] Patent Number: 5,553,527

[45] Date of Patent: Sep. 10, 1996

[54] MICRO SMOOTH GUITAR SLIDE

[76] Inventor: Sterling T. Harrison, 4410 O'Meara, Houston, Tex. 77035

[21] Appl. No.: 247,508

[22] Filed: May 23, 1994

Related U.S. Application Data

[63] Continuation of Ser. No. 37,249, Mar. 24, 1993, abandoned.

[51] Int. Cl.[6] ..... G10D 3/00

[52] U.S. Cl. ..... 84/319; 84/322; 204/662

[58] Field of Search ..... 84/315, 319; 204/129.1, 204/DIG. 7

[56] References Cited

U.S. PATENT DOCUMENTS 3,638,525 2/1972 Sciurba et al. ..... 84/319
3,741,065 6/1973 Harris ..... 84/319
4,148,707 4/1979 Mayer et al. ..... 204/297 W
4,817,488 4/1989 de los Santos ..... 84/319
4,969,382 11/1990 Hein, III et al. ..... 84/319

*Primary Examiner*—Patrick J. Stanzione
*Attorney, Agent, or Firm*—Mark A. Oathout

[57] ABSTRACT

The present invention includes a micro smooth surface on a stainless steel guitar slide. The micro smooth finish is achieved by a combination of mechanical polishing and electropolishing techniques applied to the surface of a corrosion resistant and durable stainless steel tubular member.

10 Claims, 5 Drawing Sheets

MICRO SMOOTH GUITAR SLIDE

This application is a continuation of patent application Ser. No. 08/037,249, filed Mar. 23, 1993, now abandoned.

BACKGROUND

The classic slide guitar technique originated in the deep South long ago, evolving through a number of musical genres from Gospel to Rock & Roll. It has always been primarily a staple of blues, folk, country and rock guitarists and was usually called "bottleneck" guitar playing, because the players generally used the neck of a glass bottle to fret the notes on an acoustic guitar. The "bottleneck" sound is one-of-a-kind.

However, when a glass slide is used on a metal string the glass will wear down. This impedes movement of the slide across the strings and affects the quality of the resulting sound. Glass also breaks when dropped and is dangerous when broken.

Many variations of the bottleneck have been developed in an attempt to produce its unmistakable sound. Over the years, the variations have achieved varying degrees of success, but no product has been able to capture that elusive tonality of glass on metal strings, combined with the ease of playing comfort sought by acoustic and electric musicians alike.

The most common slide currently in use is a chrome-plated tube that slips over the musician's finger. However, the chrome plating on the tube will frequently begin to wear after about one year. Once the chrome plating is removed or worn the tube will begin to corrode. Any wear or corrosion on the surface of the slide will effect the quality of the sound achieved and the ease of movement of the slide across the strings. Additionally, although chrome plating is visually a smooth surface, the surface is substantially more porous than glass and therefore effects the sound and ease of sliding across the strings.

It is believed prior metallic guitar slides did not have a surface finish of better than twenty to thirty-two micro-inches.

A need therefore exists for a guitar slide which is resistant to wear caused by the guitar strings, is non-corrosive and which has a smoothness comparable to glass.

SUMMARY

The present invention is designed to satisfy the above mentioned needs. The major distinguishing feature of the present invention is the outer diameter or OD surface of the guitar slide. The present invention includes a micro smooth surface on a stainless steel guitar slide. The micro smooth finish is achieved by a combination of mechanical polishing and electropolishing techniques applied to the surface of a corrosion resistant stainless steel tube. By using the advanced micropolishing process, applicant has produced a stainless steel slide with a metallic surface which is as smooth as glass. This combines the sound of the bottleneck with the durability and ease of a steel tube slide.

The micro smoothing process is applied to the outer diameter of the slide until a glassy smooth finish is achieved. The invention has resulted in the following advantages:

A smooth-as-glass surface for optimum sound; unwanted vibrations are virtually eliminated; uneven attack from string to string is eliminated; superior appearance and tonality; ability to gage and sustain tone due to precision controlled wall thickness of the slide; elimination of microcracks and internal crevices which greatly enhance the life of the guitar slide finish; no sharp points or burrs on the guitar slide; ease of use; comfort; various thicknesses of metal for satisfactory weight and sensitivity; and durability which should last for the lifetime of the user thereby exceeding the life of other slides currently on the market.

DETAILED DESCRIPTION

Figure 3:
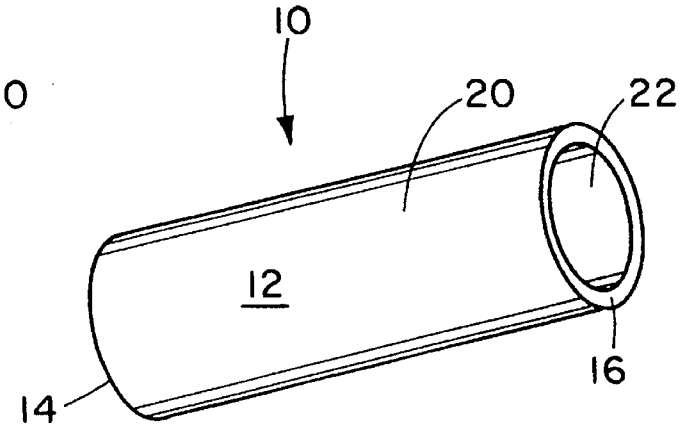
FIG. 3 is an isometric view of the guitar slide.
Figure 1:
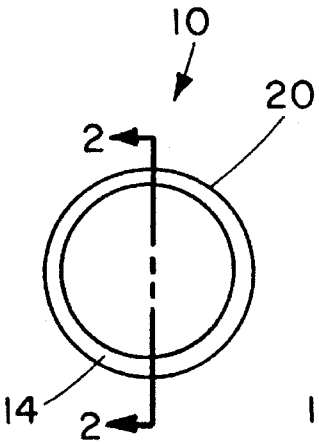
FIG. 1 is an end view of the guitar slide.
Figure 2:
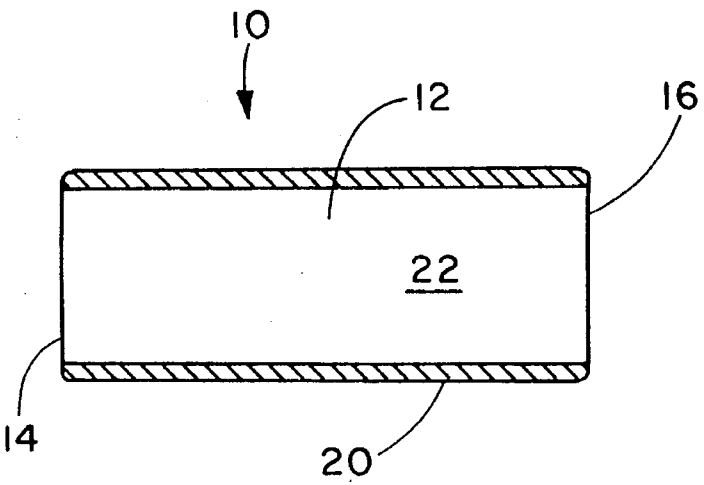
FIG. 2 is a cross sectional view taken along line 2—2 of FIG. 1.
Figure 5:
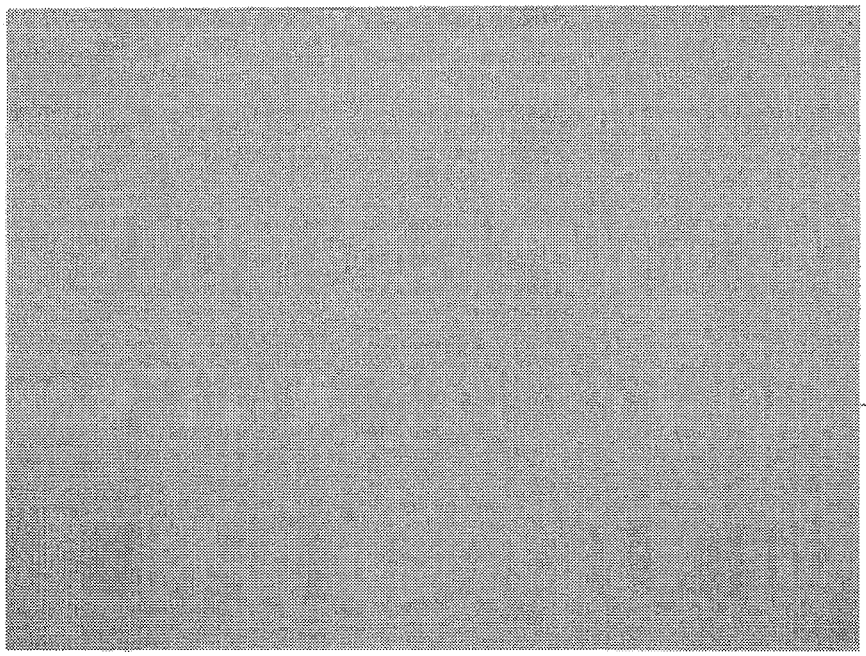
FIG. 5 is a magnified (100×) view of the surface of an electropolished guitar slide.
Figure 6:
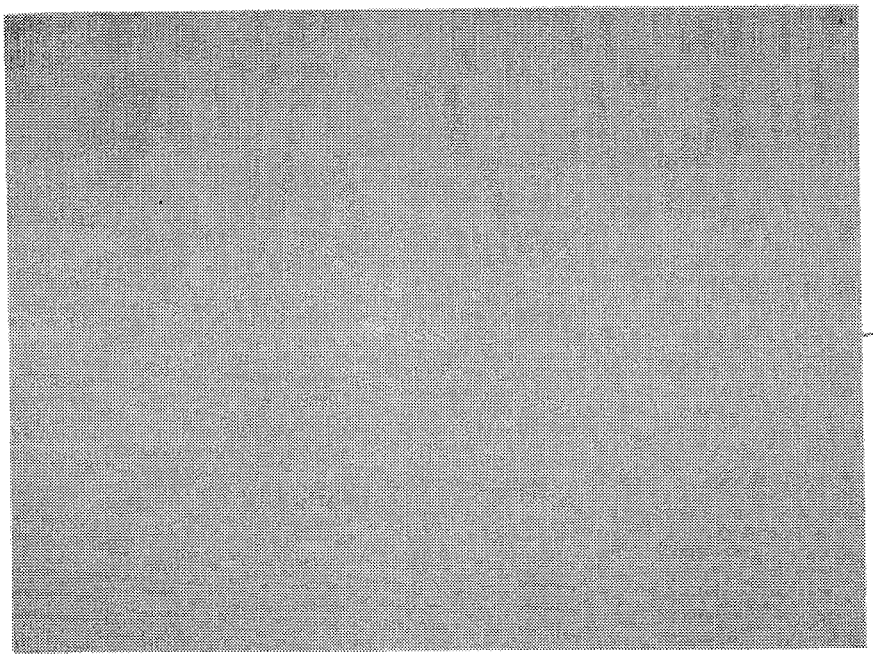
FIG. 6 is a magnified (250×) view of the surface of an electropolished guitar slide.

Referring to FIGS. 1–3, one embodiment of a micro smooth guitar slide 10 is shown. The guitar slide 10 is made from a tubular member 12 having ends 14 and 16. The tubular member 12 defines a central bore for the insertion of a finger of the musician using the guitar slide 10. The outer surface 20 of the tubular member 12 is polished to a micro smooth finish (as shown in FIGS. 5 and 6). The inner surface 22 and ends 14 and 16 can be similarly polished.

The tubular member 12 is preferably made of stainless steel to inhibit corrosion. The guitar slide 10 may be constructed from other members (not shown) having tube like shapes so long as the member can fit over the finger of the player. The preferred embodiment of the invention would be a tubular member 12 cut from drawn seamless tubing which is mechanically polished and then electropolished as described below.

In order to obtain the final desired surface finish, mechanical polishing techniques are an important precursor to the electropolishing process. The surface finish obtained from electropolishing is directly related to the pre-electropolished surface quality. Electropolishing cannot completely remove inclusions, gouges, scratches and the like. Therefore, prior to electropolishing multiple passes of ever finer abrasive techniques are recommended. Coarse grits such as grits less than 80 grit should be avoided.

Figure 7:
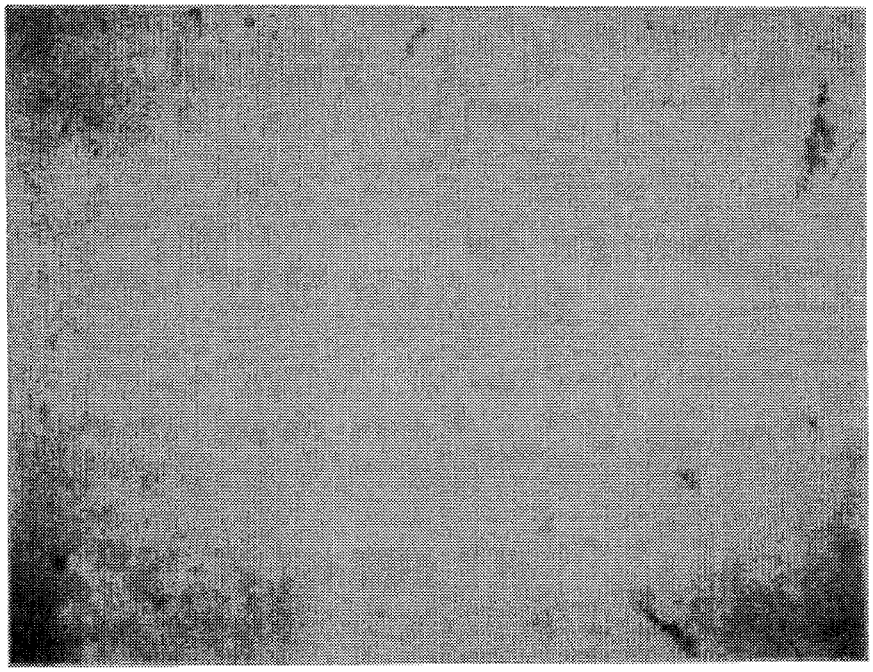
FIG. 7 is a magnified (100×) view of the surface of a chromium plated guitar slide.

Several mechanical polishing techniques may be utilized including the use of compounds such as green chromium, fabric wheels, abrasive belt polishing, abrasive wheels which include nylon, flap wheels and combination wheels. Porous and scaled surfaces will require more mechanical polishing time and metal removal. Abrasive polishing may include the use of aluminum oxide belts or PE Wheels starting with 120 grit and progressing successively to 180, 240 and then 320 grit. The tube 12 can then be buffed with a green chromium compound. The "cold-working skin" or stress induced layer caused by mechanical polishing (FIGS. 6 and 7 show a cold-worked chromium plated surface) can then be removed by the electropolishing process.

Electropolishing is an electrochemical process whereby metal is removed ion by ion from a metal surface. This is the reverse of electroplating. Instead of grinding, milling, buffing or using other mechanical methods, the guitar slide to be electropolished is immersed in an electrolyte and exposed to direct current. Surface metal is removed by an anodic dissolution process, which occurs in an electrolyte solution, when the slide to be electropolished is subjected to DC electrical current. The process eliminates local galvanic differences caused by stress, and therefore equipotentializes the surface of the guitar slide 10.

Figure 4:
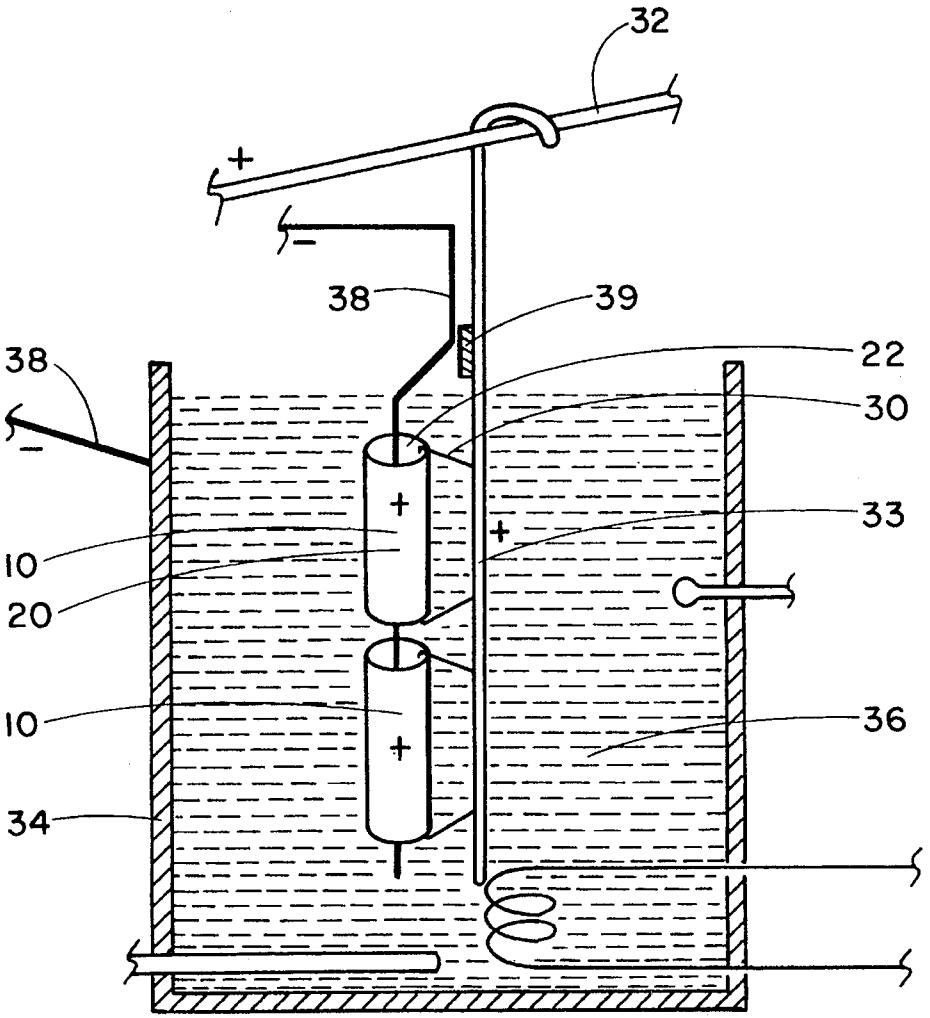
FIG. 4 is a schematic view of the electropolishing apparatus including a rack.

Electropolishing utilizes electrochemistry and the fundamental principles of electrolysis. Referring to FIG. 4, in very basic terms, the guitar slides 10 to be electropolished are placed on a rack or tooling 30 which are attached to a work rod 32 both of which are connected to be anodic 33. The rack 30 is placed in a tank 34 filled with the proper electrolytic solution 36. The guitar slide 10 emersed in the electrolyte 36 is subjected to a direct current. The electrolyte substance conducts electricity when in solution, because of its disassociation into ions. The guitar slides 10 are maintained anodic with the cathodic connection being a nearby metal piece 38, preferably stainless. An insulator 39 such as teflon may be placed between potential points of contact between the anode and cathode. An electrochemical change, in this case electropolishing, is made when current flows through an electrolyte during the electrolysis process. This electropolishing process smoothens the surface 20, 22 of the guitar slide 10.

An acceptable electrolyte is ELECTRO-GLO 300 solution, which is made for 300 series stainless steel. ELECTRO-GLO 300 solution is sold by ELECTRO-GLO which is located in Chicago, Ill. The electrolyte solution should be maintained at a temperature of between 115° and 135° fahrenheit and the guitar slide 10 may receive twelve volts for thirty seconds to one minute during the electropolishing process. All of the electropolishing equipment, such as the tank 34 and rack 30 are commercially available from electropolishing equipment suppliers.

Figure 9:
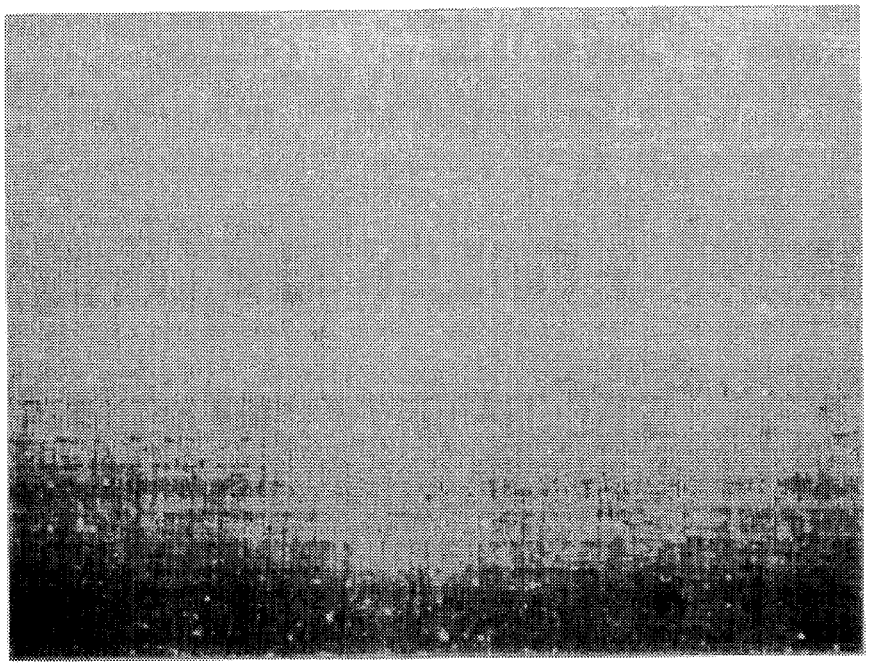
FIG. 9 is a magnified (100×) of the surface of a brass guitar slide.
Figure 10:
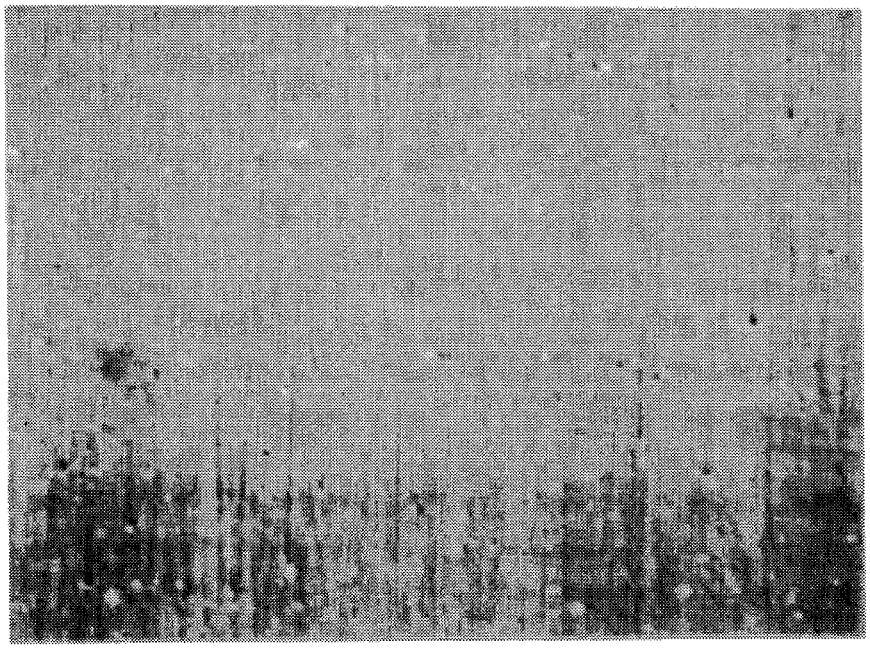
FIG. 10 is a magnified (250×) view of the surface of a brass guitar slide.

Smoothing comes about as a result of the removal of high points or peaks (see FIGS. 9–10) and the varying thickness of the chromium oxide film that covers the entire surface. The film is thickest over surface microdepressions and thinnest over surface microprojections. Where the film is thinnest, electrical resistance is the least and therefore the rate of metallic dissolution is the greatest. Electropolishing will remove the microscopic high points much faster than the rate of attack on the microdepressions. During electropolishing metal removal is controllable down to fractions of a thousandth of an inch.

Figure 8:
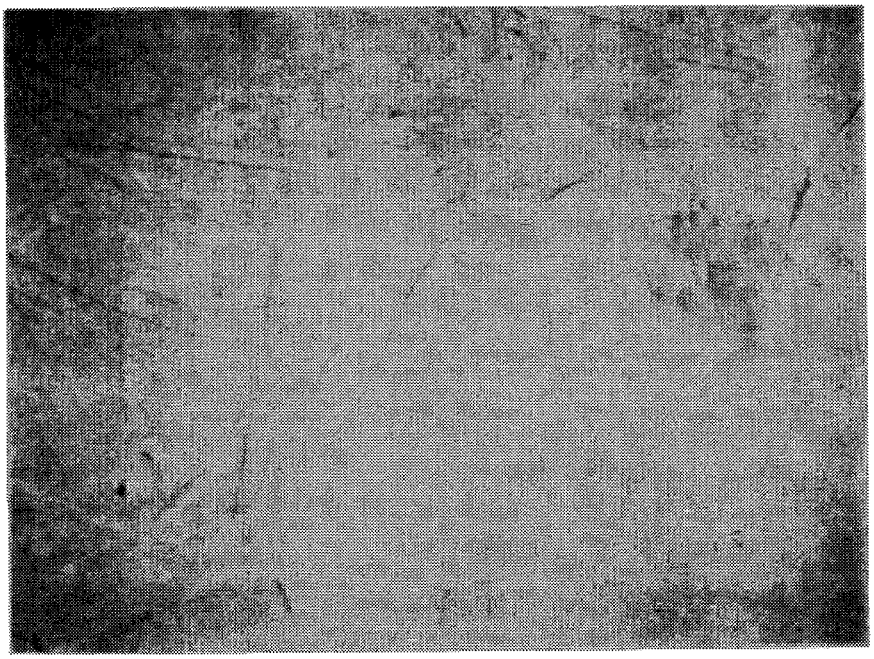
FIG. 8 is a magnified (250×) view of the surface of a chromium plated guitar slide.

An electropolished surface differs from a mechanically finished surface. Under magnification it can be seen that even very fine mechanical polishing leaves a surface with a smear and/or directionally oriented pattern or effect (see FIGS. 7–8). An electropolished surface can be characterized by the absence of scratches, strains, metal debris, and imbedded abrasives (see FIGS. 5–6). Electropolishing enhances the actual crystal structure of the metal undistorted by the cold working that accompanies mechanical finishing methods. An electropolished surface is more than just topographically different from a mechanically polished surface since cold working damage penetrates into the metal and abrasives are embedded in the surface of the metal. Techniques such as buffing decrease the microinch roughness and improve the image defining quality of the surface but they never completely remove metal damage and abrasive debris.

Electropolishing substantially reduces the surface area available for contamination pickup, and eliminates all microcracks and internal crevices. Electropolishing will generally reduce the surface roughness reading of an electropolished surface by as much as 50 percent. Electropolishing passivates the metal surface by removing any ferrites since a small amount of metal is removed during electropolishing. This serves to remove embedded contamination on the surface of the electropolished part.

The electropolishing process is effected by several other conditions in addition to the condition of the guitar slide surface 20. Several of these conditions are discussed above. A suitable electrolyte should be used, the electrolyte should be maintained at a proper temperature, and the chemistry of the electrolyte should be monitored. An adequate supply of clean, ripple free DC power should be provided. Properly sized cables and connectors should be used to make the anode and cathode connections. The DC power must be applied at the correct voltage (twelve volts) and current density (preferably 50–500 amps per square foot). The configuration of the cathode 40 also comes into play for optimum polishing. One skilled in the "art" knows how to configure the cathode for polishing the OD surface 20 or ID surface 22 of the tube 12. The cathode 40 must run through the interior of tube 12 to electropolish the inner diameter. One skilled in the art will also understand that the electrolyte must be agitated to prevent gassing streaks, flow marks etc.

Surface roughness is commonly measured or classified as microinch. The term microinch is used to denote the smoothness of ground or machined surfaces. Surface roughness may be measured with a profilometer or other surface roughness tester such as the SURFTEST 201, Series 178 commercially available from Mitutoyo located in Tokyo, Japan.

Electropolishing can be used to reduce the peaks without altering the distance between peaks at the same ratio. By reducing the peaks, the surface roughness and the surface area are both decreased. Thus, electropolishing will enhance surface smoothness and surface anti-stick properties. Microscopic examination will sometimes show up to a 90% reduction in the surface area after electropolishing. A new surface roughness reading taken after electropolishing may show as much as a 50% improvement over the reading taken prior to electropolishing. Therefore, if a five microinch finish is desired, the tube must first be mechanically polished to a surface finish of about ten microinches. After electropolishing, a metallic surface remains that is microscopically smooth, clean and bright. Applicant has obtained surface roughness readings of between one to ten microinches after electropolishing depending on the degree of mechanical polishing and other factors mentioned herein. This is similar to the surface roughness of glass. A surface which has roughness removed or rounded (surface smoothing) translates to a reduced coefficient of friction for the surface 20 of metal tube 12 and less surface drag for the guitar string (not shown).

Electropolishing promotes resistance to tarnish and corrosion in many metals and alloys. For instance, stainless steel contains metallic and non-metallic inclusions which have been unavoidably included during manufacture. Mechanical polishing not only fails to remove such inclusions, but tends to push them farther into the surface and may introduce abrasive material inclusions. Eventually the inclusions become points of corrosion. Electropolishing releases inclusions and will not introduce new inclusions. The resulting inclusion cleansed and smoothened surface 20 will be more resistant to galling which is caused by the guitar strings.

The electropolishing process can be used on stainless steels in the 202–700 grade range. The electropolishing process can be used on a variety of metals such as aluminum, brass and titanium, however, stainless steel is preferred for its durable, noncorrosive qualities and since it is well suited for electropolishing. The TEXAS BLUES TUBE™ guitar slide 10 is made from 300 series stainless steel, preferably Type 304 or Type 316 seamless tubing. The tubing is cut to length, generally two inches. Tube ends 14 and 16 are machined to have a ID/OD radius which allows for a superior comfort on the user's finger. Measurements can be taken of the users finger so that the ID can be designed and machined to custom fit the user's finger.

Once the slide 10 is cut and mechanically polished to rigorous specifications, the slide 10 is electropolished to obtain the micro smooth surface.

The preferred embodiment of the invention has been shown and described. Certain departures from the invention as shown and described can be made without departing from the spirit of the invention as claimed.

What is claimed is:

1. An apparatus for playing guitar strings having an electropolished micro smooth finish, comprising:

a metallic guitar slide including an outer surface having a finish in a range of one to nineteen microinches.

2. The apparatus according to claim 1 wherein said metallic guitar slide is a stainless steel guitar slide.

3. The apparatus according to claim 1 wherein said metallic guitar slide is a metallic tubular member.

4. The apparatus according to claim 1 wherein said finish is in the range of one of ten microinches.

5. An apparatus for playing guitar strings having an electropolished micro smooth finish, comprising:

a stainless steel tubular member including an outer surface having a finish in a range of one to nineteen microinches.

6. The apparatus according to claim 5 wherein said finish on the outer surface is in the range of one to ten microinches.

7. The apparatus according to claim 5 wherein said stainless steel tubular member includes an inner surface having a finish in a range of one to nineteen microinches.

8. A method for finishing a surface of a guitar slide, comprising the steps of:

mechanically polishing the surface of the guitar slide; and electropolishing the surface of the guitar slide.

9. The method for finishing the surface of the guitar slide according to claim 8 wherein said electropolishing step comprises:

placing the guitar slide in an electrolytic solution; and running a DC current through the slide.

10. The method for finishing the surface of the guitar slide according to claim 8, wherein said electropolishing step comprises removing a cold working skin and metal from the surface of the guitar slide by anodic dissolution.

* * * * *